US005260555A

United States Patent [19]

Sakamoto

[11] Patent Number: 5,260,555

[45] Date of Patent: Nov. 9, 1993

[54] IC MEMORY CARD HAVING DIRECT AND INDIRECT ACCESS CARD INTERFACE FUNCTIONS

[75] Inventor: Hiroyuki Sakamoto, Tokyo, Japan

[73] Assignee: Kabushiki Kaisha Toshiba, Kawasaki, Japan

[21] Appl. No.: 715,773

[22] Filed: Jun. 14, 1991

[30] Foreign Application Priority Data

Jun. 15, 1990 [JP] Japan ..... 2-156902

[51] Int. Cl.[5] ..... G06K 19/06

[52] U.S. Cl. ..... 235/492; 235/487

[58] Field of Search ..... 235/454, 487, 492

[56] References Cited

U.S. PATENT DOCUMENTS 5,097,118 3/1992 Iijima ..... 235/492

FOREIGN PATENT DOCUMENTS

0173103A2 1/1985 European Pat. Off. .
0218176A2 9/1986 European Pat. Off. .
0247788 12/1987 European Pat. Off. .
3811378A2 10/1988 Fed. Rep. of Germany .
62-177695 8/1987 Japan .
2173970 10/1986 United Kingdom .

OTHER PUBLICATIONS

Japan Electronic Industry Development Association Personal Computer Working Committee: IC Memory Card Guide Line, Ver. 3, pp. 1, 4 to 22, 34 and 35 (May/1989) (Ver. 1, Sep./1989).

*Primary Examiner*—Harold Pitts
*Attorney, Agent, or Firm*—Finnegan, Henderson, Farabow, Garrett & Dunner

[57] ABSTRACT

Interface signal lines with an external apparatus include an address signal, a data signal, a direct access read signal, a direct access write signal, an indirect access read signal, and an indirect access write signal. An IC memory card includes an address register for indirectly accessing a semiconductor memory. A first memory access means accesses an address indicated by the address signal using the direct access read and write signals. A second memory access means accesses an address of the semiconductor memory indicated by the address register using the indirect access read and write signals.

6 Claims, 5 Drawing Sheets

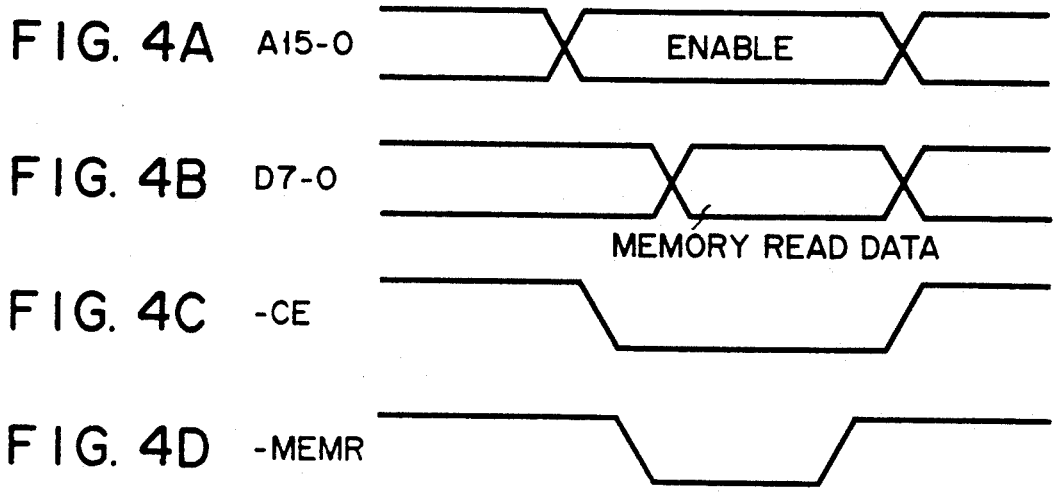
FIG. 4A
A15-0
ENABLE
FIG. 4B
D7-0
MEMORY READ DATA
FIG. 4C
-CE
FIG. 4D
-MEMR
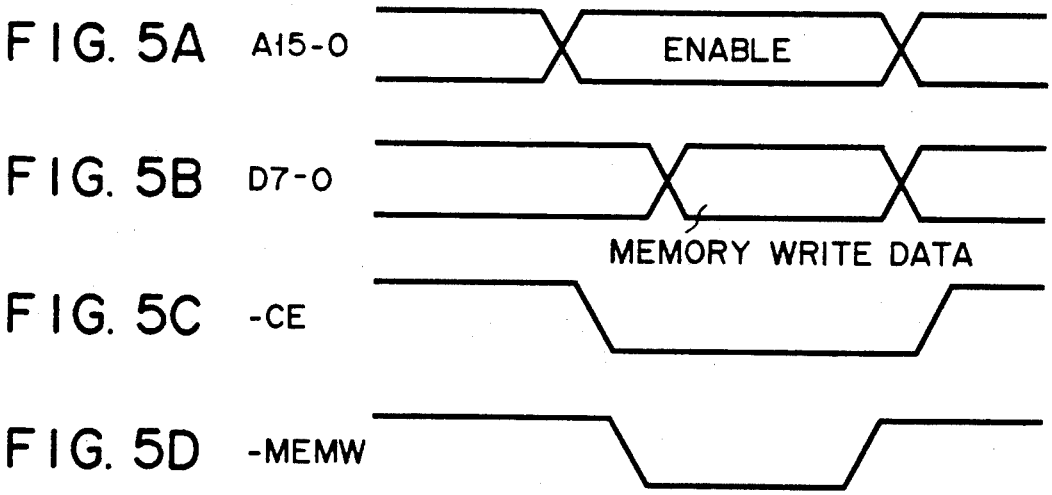
FIG. 5A
A15-0
ENABLE
FIG. 5B
D7-0
MEMORY WRITE DATA
FIG. 5C
-CE
FIG. 5D
-MEMW

IC MEMORY CARD HAVING DIRECT AND INDIRECT ACCESS CARD INTERFACE FUNCTIONS

BACKGROUND OF THE INVENTION

1. Field of the Invention

The present invention relates to an IC memory card which has a credit card size, and a thickness of 2 to 4 mm, and in which a semiconductor memory, a control circuit for reading/writing the memory, and the like are mounted.

2. Description of the Related Art

Recently, two kinds of card-size storage media, i.e., IC cards and IC memory cards are popular.

Of these media, the IC cards have a thickness of 0.76 mm, and were developed to replace existing credit cards (magnetic stripe cards). The IC cards are also called "smart cards" since they can provide various functions. The IC card incorporates a one-chip CPU, and a semiconductor memory having a relatively small capacity (8 through 64 KB).

In contrast to this, the IC memory cards satisfy the international standard regulated by the ISO. The IC memory cards have dimensions corresponding to a credit card (85.6×54.0 mm), and a thickness of about 2 to 4 mm. The IC memory card incorporates a semiconductor memory having a relatively large capacity (16 KB to several MB), and a relatively simple control circuit for reading/writing the memory. IC memory cards of this type have the following advantages, and have received a lot of attention as future storage media. Thus, a wide application field of the IC memory cards is expected.

| | |
|---|---|
| 1) compact, lightweight | compact device |
| 2) low power consumption | long-time battery drive |
| 3) high-speed access | direct execution of program |
| 4) high reliability | very low error frequency |
| 5) environmental resistance | wide temperature and humidity ranges |
| 6) portability | easy carrying, and easy insertion/removal |
| 7) wide application range | various types (ROM, RAM, and the like) are available |

FIG. 3 shows an outer appearance of the IC memory card.

In order to access the IC memory card, the following two access methods can be adopted. An external interface having the first or second access method is prepared for each card. The first method is a direct access method. In this method, a memory address is directly supplied from the external interface to access a memory. This method is used when a CPU of, e.g., a personal computer accesses a main memory, and allows high-speed memory access. The second method is an indirect access method. In this method, a memory address to be accessed is temporarily set in an address register in an IC memory card, and then, a memory is indirectly accessed. In the direct access method, although a time required for access can be shortened, the number of address signal lines is increased, and a memory address space of a CPU in a host apparatus such as a personal computer must be assured for an IC memory card.

In the indirect access method, since the number of address lines is small, an interface circuit scale in the host apparatus can also be small. Although the indirect access method does not require a memory access space in a CPU of a host apparatus, an address register must be arranged in the IC memory card, and a time required for access is prolonged more or less due to indirect access.

In this manner, the direct access method and the indirect access method have different features, and are used by utilizing their features. As a typical application, the direct access method is used when a program is directly executed on the IC memory card, since it allows high-speed access of the IC memory card. The indirect access method is used when a program or data is temporarily loaded from the IC memory card to a main memory of the host apparatus like a floppy disk, since the interface of the host apparatus is simple.

As described above, the direct access method and the indirect access method have different functions, and realize IC memory cards using unique interfaces. In general, the number of signal lines (terminals) in the direct access method is 34 to 68, and that in the indirect access method is 20 to 40.

Therefore, an IC memory card of the direct access method has no compatibility with an IC memory card of the indirect access method.

The IC memory cards have been expected as future information recording media, and various applications have been proposed. In order to use the IC memory card as a medium having a compatibility like a floppy disk, it is preferable that a single IC memory card can provide various functions while maintaining compatibility.

SUMMARY OF THE INVENTION

It is an object of the present invention to provide an IC memory card having card interface functions of both the direct access method and the indirect access method.

In order to achieve the above object, an IC memory card of the present invention comprises: memory means comprising an integrated circuit; first access means for accessing the memory means by a direct access method; second access means for accessing the memory means by an indirect access method; and means for enabling one of the first and second access means in response to an externally designated access method.

According to the present invention, in order to realize two functions, i.e., the direct access method and the indirect access method on a single IC memory card, an address signal line, and a data signal line are defined as common interface signal lines. A direct access read/write signal line, and an indirect access read/write signal line are defined. In order to realize the indirect access method, an address register, and an I/O port for reading/writing a memory, and a control signal for switching between a direct address and an indirect address are arranged in the IC memory card.

Interface signal lines with an external device include an address signal line, a data signal line, and two kinds of, i.e., direct and indirect access read and write signal lines.

The IC memory card includes an address register for indirectly accessing a semiconductor memory. The IC card memory also includes memory access means for accessing an address indicated by the address signal using direct access read and write signals, and memory access means for accessing a memory address indicated by the address register using indirect access read and write signals.

As a result, in an apparatus requiring high-speed access, a memory can be accessed by the direct access method. In an apparatus having a compact, low-cost feature, a memory can be accessed by the indirect access method. For example, the card can be applied to a case wherein data of an electronic still camera using an IC memory card is edited using a personal computer. In particular, since the electronic still camera requires a compact structure, image data is stored in the IC memory card by the indirect access method which can be realized by a simple interface, and complicated edit operations of the stored data can be executed using the high-speed direct access method. Thus, the access means can be selectively used according to purposes. The application fields of the IC memory card include:

a) data (program, dictionary, etc.) supply media for electronic notebooks
b) program supply media for game machines
c) font and program supply media for printers
d) data storage media for measurement devices
e) program storage medium for communication/control devices
f) program and data storage media for handy terminals Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIGS. 4A through 4D are timing charts showing a direct access read operation of the IC memory card of the present invention, in which FIG. 4A shows an address signal, FIG. 4B shows a data signal, FIG. 4C shows a card enable signal, and FIG. 4D shows a memory read (−MEMR) signal;

FIGS. 5A through 5D are timing charts showing a direct access write operation of the IC memory card of the present invention, in which FIG. 5A shows an address signal, FIG. 5B shows a data signal, FIG. 5C shows a card enable signal, and FIG. 5D shows a memory write (−MEMW) signal;

FIGS. 6A through 6E are timing charts showing an indirect access read operation of the IC memory card of the present invention, in which FIG. 6A shows an address signal, FIG. 6B shows a data signal, FIG. 6C shows a card enable signal, FIG. 6D shows a memory read (−IOR) signal, and FIG. 6E shows a memory write (−IOW) signal; and FIGS. 7A through 7E are timing charts showing an indirect access write operation of the IC memory card of the present invention, in which FIG. 7A shows an address signal, FIG. 7B shows a data signal, FIG. 7C shows a card enable signal, FIG. 7D shows a memory read (−IOR) signal, and FIG. 7E shows a memory write (−IOW) signal.

DETAILED DESCRIPTION OF THE PREFERRED EMBODIMENTS

Figure 1:
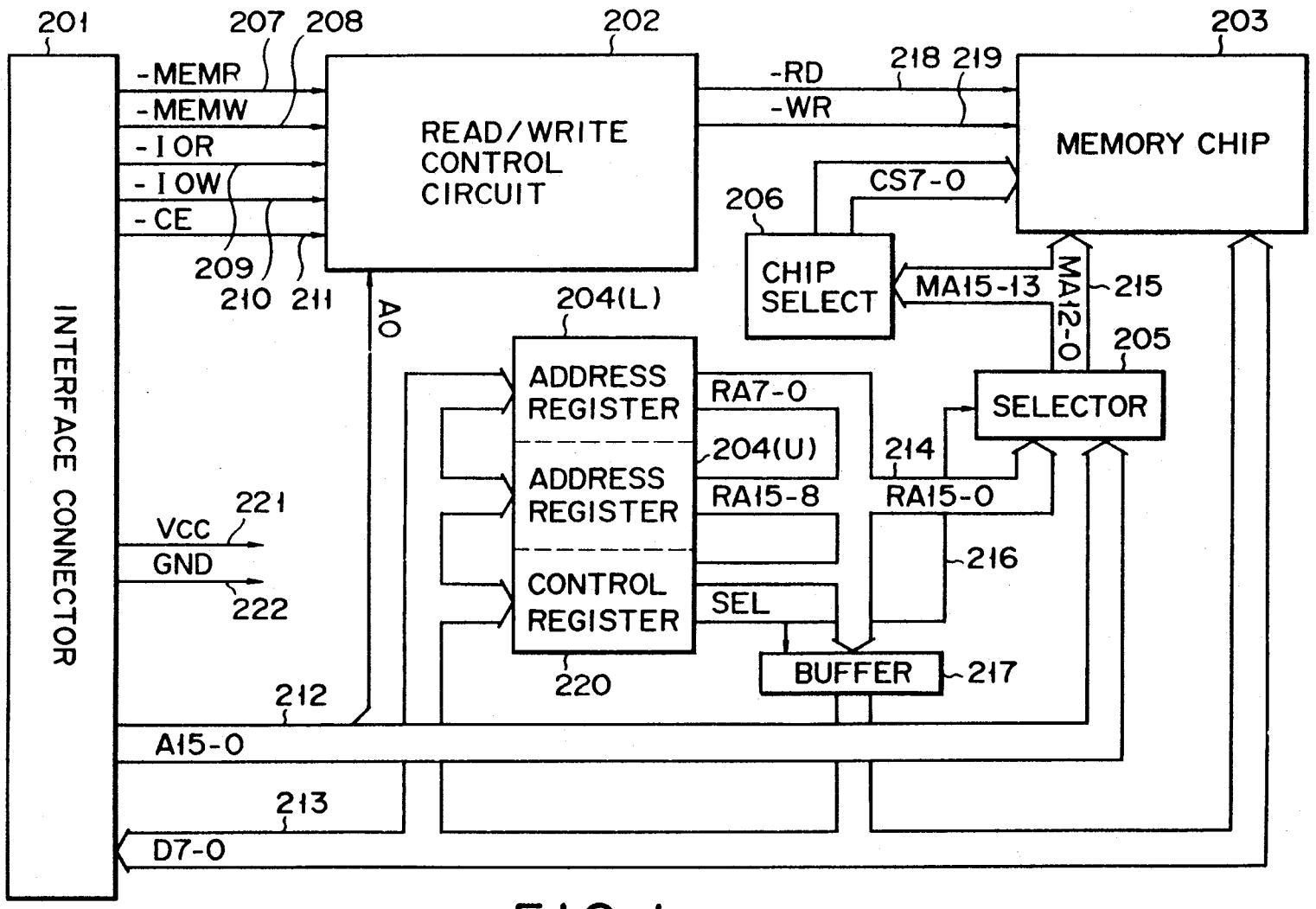
FIG. 1 is a block diagram showing an embodiment of an IC memory card of the present invention.

In FIG. 1, an interface connector 201 is connected to a terminal of an external apparatus, i.e., is connected to a host apparatus such as a personal computer. The interface connector 201 has, e.g., a two-piece connector shape (a circuit board mounting a memory is independent from a connector), and has a 68-pin structure on the basis of the guide line Ver. 4 of the JEIDA (Japan Electronic Industry Development Association). A control circuit 202 controls read/write access to a memory chip, read/write access to an I/O port in the IC memory card, and the like.

A memory chip 203 for storing a program, data, and the like is constituted by eight 64-Kbit (8K×8 bits) memory chips. The memory chip 203 may comprise a dynamic RAM, a static RAM, a mask ROM, a PROM, a flash memory, or the like.

Address registers 204 (204L and 204U) store a memory address to be accessed when the memory chip 203 is indirectly accessed. In this embodiment, an address to be set in the register consists of 16 bits, and is supplied from an external circuit via a data bus 213.

An address selector 205 selects an address to be supplied to the memory chip 203. The address selector 205 switches between a direct address (A15 through A0) and an indirect address (RA15 through RA0) in accordance with an address select signal (SEL) supplied from a control register 220.

A chip select circuit 206 decodes upper 3 bits (MA15 through MA13) of a memory address output from the address selector 205, and outputs eight chip select signals (CS7 through CS0) to the respective memory chips.

Control signals 207 through 211 are supplied from the interface connector 201 to the control circuit 202. Of these signals, the active-low memory read signal (−MEMR) 207 is output in a direct access memory read mode. The active-low memory write signal (MEMW) 208 is output in a direct access memory write mode. The active-low I/O read signal (−IOR) 209 is output in an indirect access memory read mode. The active-low I/O write signal (−IOW) 210 is output in an indirect access memory read mode. The active-low card enable signal (−CE) 211 is output when the IC memory card is accessed. An address bus 212 transfers a 16-bit address signal (A15 through A0). In the case of a direct address, a 16-bit address (A15 through A0) received by the interface connector 201 is supplied to the memory chip 203 via the address selector 205. In the case of an indirect address, the least significant bit (=A0) is used as a signal line for designating a select register 301, and a data register 302. The bidirectional data bus 213 transfers an 8-bit data signal (D7 through D0). A 16-bit address signal (RA15 through RA0) 214 for the indirect access mode consists of lower (L) and upper (U) 8-bit address signals output from the address registers 204 (204L and 204U), and is sent to the address selector 205, and a buffer 217. A memory address (MA15 through MA0) is output from the address selector 205. An address select signal (SEL) 216 is output from the control register 220. An address to be selected by the address selector 205 is switched depending on the direct or indirect access mode, thereby generating address signals to the memory chip 203. When the address select signal (SEL) 216 is "0", the direct address (A15 through A0) is selected; when it is "1", the indirect address (RA15 through RA0) is selected. The buffer 217 is used when the contents of the address registers 204 (204L and 204U) or the content of the control register is read from the host apparatus. An active-low read signal 218 is supplied to the memory chip 203. An active-low write signal (−WR) 219 is supplied to the memory chip 203.

The control register 220 outputs the address select signal (SEL) for controlling the address selector 205. More specifically, the address select signal (SEL) for switching between the direct address (A15 through A0) and the indirect address (RA15 through RA0) is set in the control register 220 via the data bus 213. In this case, when the address select signal (SEL) is "0", the direct address (A15 through A0) is selected; when it is "1", the indirect address (RA15 through RA0) is selected. The control register 220 is reset to "0" upon power-on.

A power supply line (Vcc line) 221 receives a power supply voltage of +5 V in a normal mounting state. Reference numeral 222 denotes a ground line.

Figure 2:
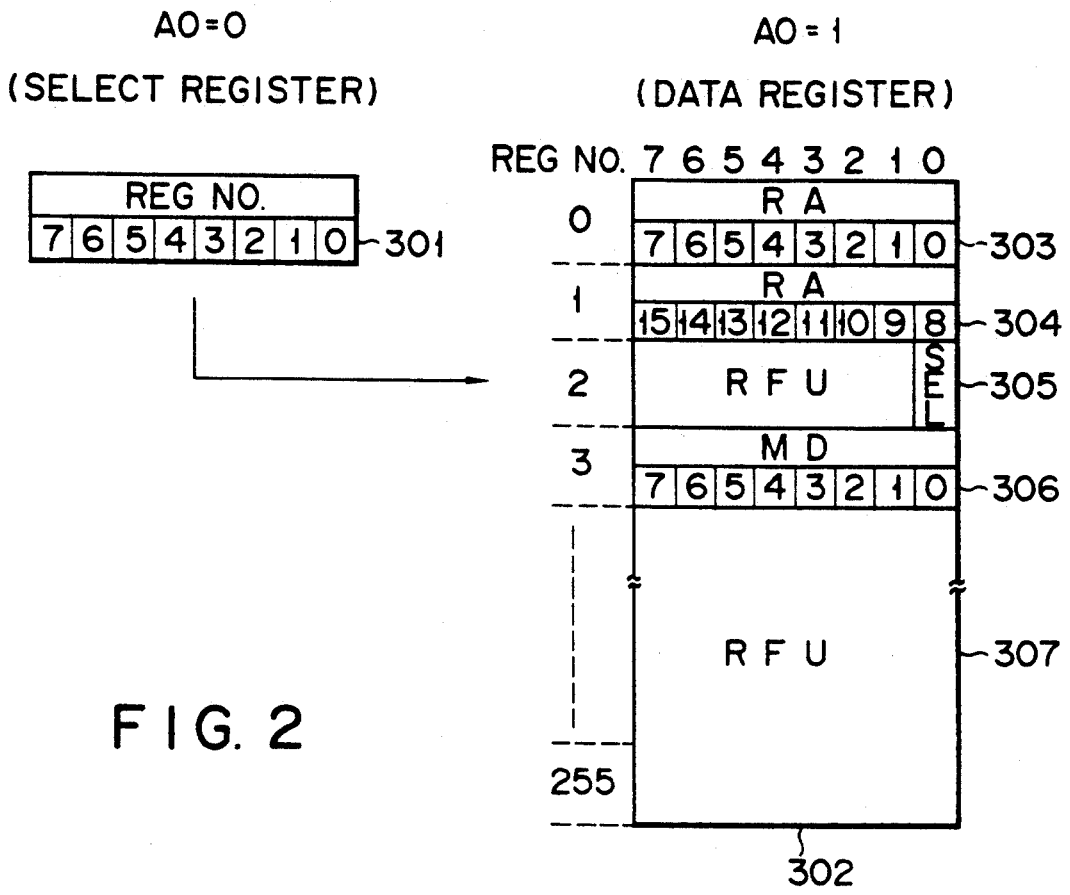
FIG. 2 is a block diagram showing a logic structure of registers incorporated in a control circuit shown in FIG. 1.

FIG. 2 shows a logic structure of registers for realizing the indirect access method in this embodiment. A select register 301 and a data register 302 are incorporated in the read/write control circuit 202 shown in FIG. 1. In FIG. 1, the data register 302 is partially illustrated outside the read/write control circuit 202 for the sake of easy understanding of the present invention.

In FIG. 2, the select register 301 is arranged to selectively set data in the data register 302 (303 through 306; to be described later). When the data register 302 is to be accessed, a register number (0, 1, . . . , 255) is set in the select register 301, and thereafter, one register in the data register 302 is accessed. The select register 301 can be accessed when the least significant bit (A0) of the address signal 212 is "0". More specifically, in order to make read or write access to the select register 301, the least significant bit (A0) of the address signal 212 is set to be "0", and the I/O read signal (−IOR) or the I/O write signal (−IOW) is output, thus allowing read or write access. The select register 301 has an 8-bit arrangement, and can select a maximum of 256 registers 303, 304, . . . constituting the data register 302. In order to make read or write access to the data register 302, the least significant bit (A0) of the address signal 212 is set to be "1", and the I/O read signal (−IOR) or the I/O write signal (−IOW) is output. A maximum of 256 registers can be selected. In this embodiment, only four registers (303, 304, 305, and 306) of register numbers 0 through 3 are used, and the remaining registers are RFU (Reserved For Use).

The address register 303 stores lower 8 bits (RA7 through RA0) of an address, and physically corresponds to the address register 204L shown in FIG. 1. The address register 304 stores upper 8 bits (RA15 through RA8) of an address, and physically corresponds to the address register 204U shown in FIG. 1.

The control register 305 is set with the address select signal (SEL) at its bit 0, and physically corresponds to the control register 220 shown in FIG. 1. When a direct address is to be accessed, "0" is set in bit 0; when an indirect address is to be accessed, "1" is set in bit 0. When the power switch of the memory card is turned on, the address select signal (SEL) is reset to "0".

The port 306 is used to read/write memory data. The address select signal (SEL) is set to be "1" to read/write a memory content at a preset indirect address (RA15 through RA0). When lower bits of an address are set from the host side in the address register 204L, "0" is written in the select register 301, and the lower address bits are written in the register 303. When upper bits of an address are to be set in the address register 204H, "1" is written in the select register 301, and upper address bits are written in the register 304. When control data is to be written in the control register 220, "2" is written in the select register 301, and "0" (direct access) or "1" (indirect access) is written in the least significant bit of the register 305.

Figure 3:
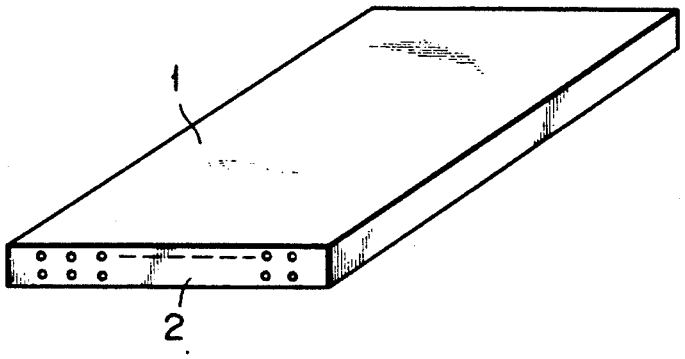
FIG. 3 is a perspective view showing an outer appearance of the IC memory card shown in FIG. 1.
Figures 6A, 6B, 6C, 6D, 6E:
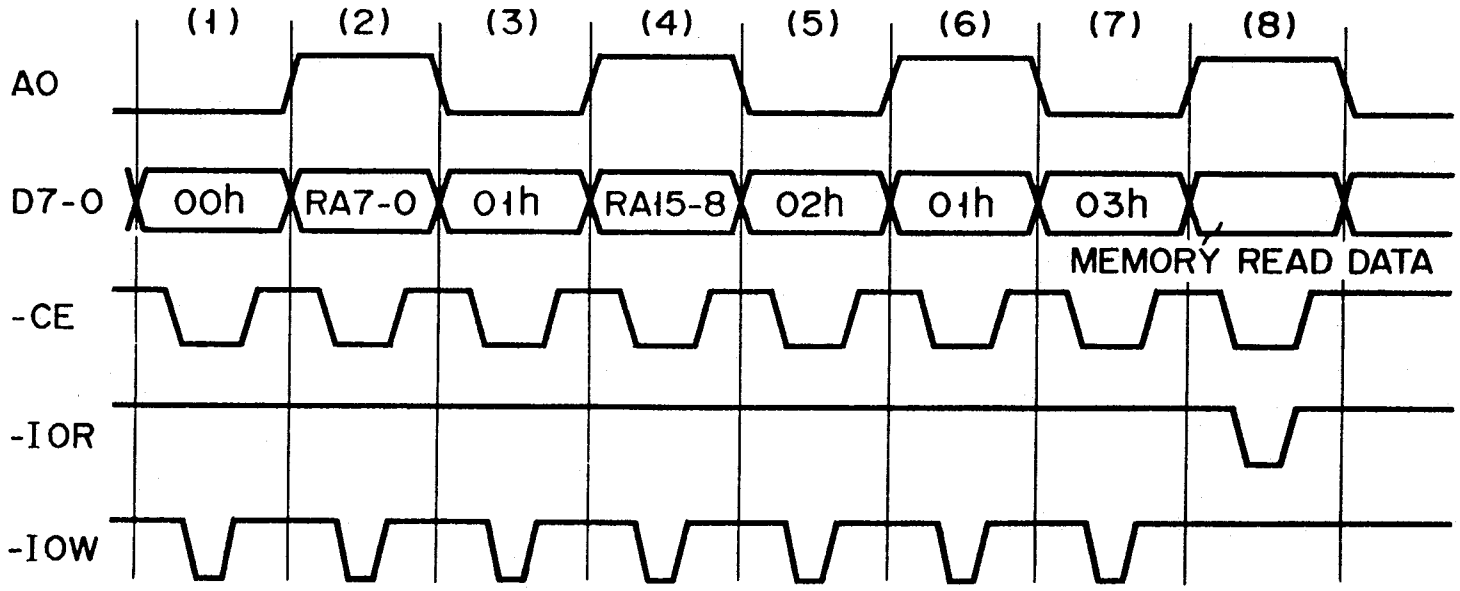
Figures 7A, 7B, 7C, 7D, 7E:
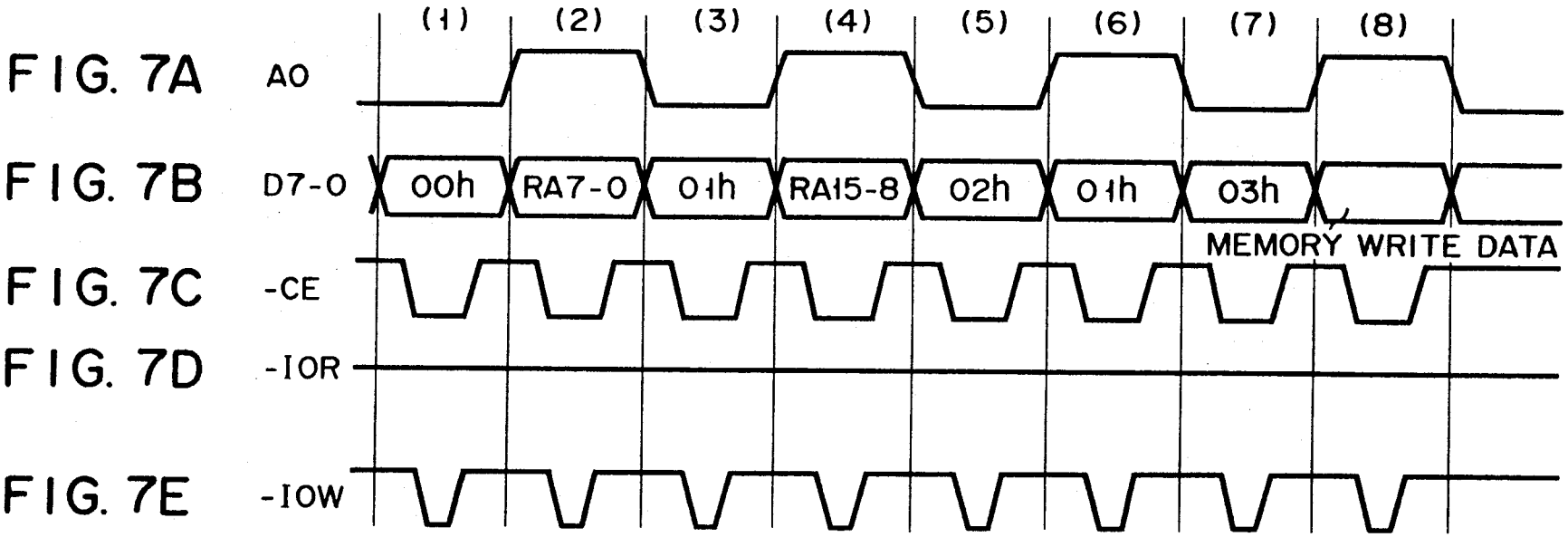

FIG. 3 shows an outer appearance of the IC memory card according to the embodiment of the present invention. The IC memory card is formed to have outer dimensions of a length =85.6 mm, a width =54 mm, and a thickness of 3.3 mm. A battery holder, and a write protect switch (neither are shown) are arranged on the IC memory card. The functional electronic circuit shown in FIG. 1 including the memory chip 203, the control circuit 202, and the like is arranged in a base unit 1 of the card. A connector 2 has a connector receptacle side terminal structure corresponding to a 68-pin (34 pins×2) plug-in terminal.

FIGS. 4A through 4D and FIGS. 5A through 5D are timing charts showing direct access operation timings in this embodiment. FIGS. 4A through 4D show a direct access read timing, and FIGS. 5A through 5D show a direct access write timing. In the direct access read operation shown in FIGS. 4A through 4D, a memory address to be accessed is sent from the host apparatus onto the address bus 212 via the interface connector 201 as a direct address (A15 through A0), and the active-low card enable signal (−CE) (a control signal for controlling an operation/standby mode and a byte access/word access mode of the memory card), and the memory read signal (−MEMR) are sent to the control circuit 202. Thus, memory read data read out from the memory chip 203 is output onto the data bus 213 as a data signal (D7 through D0). In a direct access write operation shown in FIGS. 5A through 5D, a memory address to be accessed is sent from the host apparatus onto the address bus 212 via the interface connector 201 as a direct address (A15 through A0), memory write data (D7 to D0) is sent onto the data bus 213, and the active-low card enable signal (−CE) and the memory write signal (−MEMW) are sent to the control circuit 202. Thus, memory write data (D7 to D0) on the data bus 213 is written in an address area of the memory chip 203, which area is designated by the address bus 212.

FIGS. 6A through 6E and FIGS. 7A through 7E are timing charts showing indirect access operation timings in this embodiment. FIGS. 6A through 6E show indirect access read operation timings, and FIGS. 7A through 7E show indirect access write operation timings. At indirect read operation timings shown in FIGS. 6A through 6E, "0" is written in the select register 301 at a timing (1). Lower memory address bits are written in the register 303 corresponding to the address register 204L at a timing (2). "1" is written in the select register 301 at a timing (3). Upper memory address bits are written in the register 304 corresponding to the address register 204U at a timing (4). "2" is written in the select register 301 at a timing (5). "1" is written in the least significant bit of the register 305 corresponding to the control register 220 as the address select signal (SEL) at a timing (6). "3" is written in the select register 301 at a timing (7). Data is read out from the memory chip 203 and is written in the register 306 at a timing (8). Thus lower 8 bits (RA7 through RA0) of an address are set in the address register 204L, upper 8 bits (RA15 through RA8) of the address are set in the address register 204U, and "1" (SEL="1") is set in the control register 220.

In an indirect access write operation shown in FIGS. 7A through 7E, "0" is written in the select register 301 at a timing (1). Lower address bits are written in the register 303 corresponding to the address register 204L at a timing (2). "1" is written in the select register 301 at a timing (3). Upper memory address bits are written in the register 304 corresponding to the address register 204U at a timing (4). "2" is written in the select register 301 at a timing (5). "1" is written in the least significant bit of the register 305 corresponding to the control register 220 as the address select signal (SEL) at a timing (6). "3" is written in the select register 301 at a timing (7), and data is written in the memory chip 203 at a timing (8).

An operation of the embodiment of the present invention will be described hereinafter with reference to FIGS. 1 through 7E.

The operations of the direct access method will be described below with reference to FIGS. 1 through 5D.

Interface signals used in the direct access method include an address signal (A15 through A0), a data signal (D7 through D0), a memory read signal (−MEMR), and a card enable signal (−CE). The card enable signal (−CE) must be output at all the timings for accessing the IC memory card.

In order to make read access to the memory in the IC memory card, when an address signal (A15 through A0) and a memory read signal (−MEMR) are output, the content at the memory address indicated by the address signal (A15 through A0) is read out from the memory chip 203, and is output onto the data bus 213 as a data signal (D7 through D0). The data signal is then fetched by the host apparatus. The memory access timings in this case are shown in FIGS. 4A through 4D.

In order to make write access to the memory in the IC memory card, when the host apparatus outputs an address signal (A15 through A0), a data signal (D7 through D0), and a memory write signal (−MEMW), the content of the data signal (D7 through D0) is written at the memory address on the memory chip 203, indicated by the address signal (A15 through A0). The memory access timings in this case are shown in FIGS. 5A through 5D.

In the direct access mode, the address select signal (SEL) must be "0". However, when the power switch of the IC memory card is turned on, the address select signal (SEL) is automatically reset to "0". For this reason, when access is not made by the indirect access method, the state of the address select signal (SEL) need not be considered. More specifically, the indirect access method may be provided to the IC card as an optional function. In this case, it is important to execute the direct access independently of the presence of the indirect access method.

The operations of the indirect access method will be described below with reference to FIGS. 1, 2, 6A through 6E, and 7A through 7E.

Interface signals used in the indirect access method include an address signal (A0), a data signal (D7 through D0), an I/O read signal (−IOR), an I/O write signal (−IOW), and a card enable signal (−CE).

As described above, the card enable signal (−CE) must be output at all the timings for accessing the IC memory card.

In order to make indirect access, an address to be accessed must be set in the address registers 204 (204L and 204U). In order to set lower address bits (RA7 through RA0), "0" is written in the select register 301. More specifically, the address signal (A0) is set to be "0", the data signal (D7 through D0) is set to be "0", and the I/O write signal (−IOW) is output. The lower address bits (RA7 through RA0) to be accessed are written in the register 303 corresponding to the address register 204L. In this case, the address signal (A0) is set to be "1", lower address bits are output as the data signal (D7 through D0), and the I/O write signal (−IOW) is output, thereby setting the lower address bits in the register 303 (address register 204L). Upper address bits (RA15 through RA8) are written in the address register 204U by the same means. In this case, "1" is written in the select register to select the register 304 (address register 204U) for storing the upper address bits. Upon completion of setup of the address registers as described above, "1" is set in the address select signal (SEL) to select an indirect address. In this case, "2" is written in the select register 301, "1" is set in the address signal (A0), "1" is set in bit 0 of the data signal (D7 through D0) to set the address select signal (SEL) to be "1", and the I/O write signal (−IOW) is output. In order to make read/write access of the memory, "3" is set in the select register 301 to select the memory read/write port (register 306). When the I/O read signal (−IOR) is output in this state, data can be read out from the memory chip 203. When data to be written in the memory chip 203 is output onto the data bus 213, and the I/O write signal (−IOW) is output, data can be written in the memory chip 203. The memory read access timings in this case are shown in FIGS. 6A through 6E, and the memory write access timings are shown in FIGS. 7A through 7E.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An IC memory card comprising:

memory means comprising an integrated circuit;

first access means for accessing said memory means by a direct access method;

second access means for accessing said memory means by an indirect access method; and means for enabling one of said first and second access means in response to an externally designated access method.

2. A card according to claim 1, further comprising an interface connector connected to an external apparatus.

3. A card according to claim 2, wherein a direct access memory read signal used when said external apparatus makes read access to said memory means by the direct access method, a direct access write signal used when said external apparatus makes write access to said memory means by the direct access method, an indirect access memory read signal used when said external apparatus makes read access to said memory means by the indirect access method, and an indirect access memory write signal used when said external apparatus makes write access to said memory means by the indirect access method are assigned to said interface connector.

4. A card according to claim 1, further comprising an address register for storing an address for the indirect access method.

5. A card according to claim 4, further comprising address switching means for selecting one of a direct access address signal supplied from said external apparatus, and an indirect access address signal stored in said address register, and supplying the selected address signal to said memory means.

6. A card according to claim 3, wherein a power supply line for receiving electrical power from said external apparatus is assigned to said interface connector, and said card further comprises means for setting one of the direct access method and the indirect access method in response to power supply from said external apparatus.

* * * * *